US008079617B2

(12) United States Patent
Lenhart

(10) Patent No.: US 8,079,617 B2
(45) Date of Patent: Dec. 20, 2011

(54) POLE GRIP

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 408 days.

(21) Appl. No.: 12/278,209

(22) PCT Filed: Feb. 1, 2007

(86) PCT No.: PCT/CH2007/000051
§ 371 (c)(1),
(2), (4) Date: Dec. 9, 2008

(87) PCT Pub. No.: WO2007/090310
PCT Pub. Date: Aug. 16, 2007

(65) Prior Publication Data

US 2009/0174178 A1 Jul. 9, 2009

(30) Foreign Application Priority Data

Feb. 7, 2006 (CH) ..... 0184/06

(51) Int. Cl.
*A63C 11/00* (2006.01)
*A61H 3/02* (2006.01)
*A47B 95/02* (2006.01)

(52) U.S. Cl. ..... 280/822; 280/821; 135/72; 16/110.1

(58) Field of Classification Search ..... 280/821, 280/822, 809, 816, 823; 135/72; 294/25; 16/110.1, 111.1, 421, 436
See application file for complete search history.

(56) References Cited

U.S. PATENT DOCUMENTS 5,312,134 A * 5/1994 Goode et al. ..... 280/822
5,470,108 A * 11/1995 Goode et al. ..... 280/823
5,516,150 A * 5/1996 Goode et al. ..... 280/821
(Continued)

FOREIGN PATENT DOCUMENTS

DE 28 08 549 A1 9/1979
(Continued)

*Primary Examiner* — J. Allen Shriver, II
*Assistant Examiner* — James M Dolak
(74) *Attorney, Agent, or Firm* — Sughrue Mion, PLLC

(57) ABSTRACT

A stick handle (1) is described, in particular for walking sticks, trekking sticks, alpine ski sticks, cross-country sticks and Nordic walking sticks, with a handle body (14) and with a device (8-11, 15) for the self-latching fastening of a hand-holding device (25), in particular in the form of a hand loop or a glove. For the self-latching fastening, the device (8-11, 15) comprises at least one recess (10) for receiving a coupling element (33), in particular preferably in the form of a clip or a loop, provided on the hand-holding device (25), wherein the device (8-11, 15) has a clamping element (8), and the recess (10) of the device (8-11, 15) is exposed in an insertion position (A) of the clumping element (8) in such a manner that the coupling element (33) of a hand-holding device (25) not connected to the stick handle (1) can be inserted into said recess (10), and wherein the device (8-11, 15) can be brought by tilting or displacement of the clamping element (8) into a locking position (B) in which the recess (10) is closed and the coupling element (33) is trapped in the recess (10).

13 Claims, 6 Drawing Sheets

U.S. PATENT DOCUMENTS

| | | | | | |
|---|---|---|---|---|---|
| 5,887,282 | A | * | 3/1999 | Lenhart | 2/159 |
| D416,374 | S | * | 11/1999 | Lenhart | D2/618 |
| 6,325,418 | B1 | * | 12/2001 | Lenhart | 280/821 |
| 7,226,084 | B2 | * | 6/2007 | Lenhart | 280/822 |
| 7,665,769 | B2 | * | 2/2010 | Lenhart | 280/822 |
| 7,690,085 | B2 | * | 4/2010 | Lenhart | 16/436 |
| 2005/0225070 | A1 | * | 10/2005 | Lenhart | 280/821 |

FOREIGN PATENT DOCUMENTS

| | | | | |
|---|---|---|---|---|
| DE | 197 51 978 | C2 | | 5/1999 |
| DE | 202 19 461 | U1 | | 5/2004 |
| WO | WO 2004052476 | A1 | * | 6/2004 |
| WO | 2006/066423 | A1 | | 6/2006 |

* cited by examiner

POLE GRIP

TECHNICAL FIELD

The invention relates to a pole grip, in particular for walking poles, trekking poles, alpine ski poles, cross-country ski poles and Nordic walking poles. The pole grip comprises a grip body with a device for self-latching fastening of a hand-retaining device, in particular in the form a wrist strap or glove.

PRIOR ART

In such a device, which is known, for example, from U.S. Pat. No. 5,516,150 from Goode et al., a hook is provided on the pole grip and on the associated glove in the region between the thumb and forefinger a rigid, clip-shaped device is provided formed from a curved metal element. The clip is inserted with its long limb into a narrow slit of the hook, and via the hook-like device the clip and thus the glove are fixed to the pole grip.

In this connection, a slight widening of the slit is provided at the bottom of the hook which has the result that, when inserted into the hook, the clip initially forces the two limbs of the hook slightly apart, and in that the limbs only return to their original position when the clip has been pushed into the widening.

Thus an elastic deformation of the hook-like device is used to ensure easy fixing of the clip in the hook and to prevent the clip from easily slipping out of the hook.

A difficulty with such devices is, amongst others, the fact that repeated deformations of such components, which generally are formed from plastics or metal, are undesirable due to fatigue phenomena.

Moreover, the problem results, in particular, that the elastic deformation behavior of materials is highly dependent on temperature. Thus the fixing effect, which is maintained by the deformation, may be neither adjusted nor constant at different temperatures.

This is completely unacceptable, in particular in the sports field, as very large temperature differences are unavoidable, on the one hand, as a result of different weather conditions and, on the other hand, as a result of heating up during use.

An alternative variant is disclosed in U.S. Pat. No. 5,470,108, also from Goode et al. In the construction disclosed there, a slide is arranged on the top of the pole grip which may be actively pushed with the thumb from an open position, in which a slit for inserting a clip on the hand-retaining device is open at the top, into a closed position, in which the slit is closed. This construction, however, is not a self-latching construction, i.e. for securing the clip, the slide has to be actively displaced by the thumb. This is a considerable disadvantage, compared with other constructions which are, however, in principle configured completely differently and which are configured to be self-latching, such as disclosed in DE 202 19 461 U1.

DESCRIPTION OF THE INVENTION

Accordingly, the object of the invention is, amongst others, to provide an improved pole grip to which a hand-retaining device may be releasably fastened.

This object is achieved, amongst others, in that with a pole grip, in particular for walking poles, trekking poles, alpine ski poles, cross-country ski poles and Nordic walking poles, comprising a grip body, a device is provided for self-latching fastening of a hand-retaining device, in particular in the form of a wrist strap or glove, the device for self-latching fastening comprising at least one recess for receiving a coupling element provided on the hand-retaining device, the device comprising a clamping element and the recess of the device in an inserting position A of the clamping element being open such that the coupling element of a hand-retaining device not connected to the pole grip may be inserted into this recess, and the device being able to be moved into a locked position B, by tilting or displacing the clamping element, in which the recess is closed and the coupling element is trapped in the recess, i.e. may not be removed from the pole grip without a specific application of force.

This is in contrast to the solutions according to the prior art in which a self-latching mechanism is provided for fastening a hand-retaining device. In these solutions according to the prior art, a locking element is provided in the pole grip or on the pole grip and which is acted upon by a return force. The locking element is in this case according to the prior art tensioned against a stop, and when inserting a coupling element at the time of insertion is briefly displaced and subsequently springs back again into the original position. In contrast thereto, the proposed solution has a clamping element which has two different positions, namely a first position, the so-called inserting position A, in which the recess for inserting the coupling element is open, and a second position, the so-called locked position B, in which the recess is closed, i.e. a coupling element arranged therein is trapped. The inserting position A is, in this case, in a similar manner to the locked position B, a position of equilibrium of the coupling element. Accordingly, there are two different positions A and B and it is not necessary to subject the clamping element to a spring force. Accordingly, it is a surprisingly structurally simple solution, which accordingly is also cost-effective and less susceptible to error.

A first preferred embodiment of the pole grip is characterized in that the clamping element is arranged rotatably or displaceably in a recess in the top region of the pole grip. Typically, it is a recess in the top region which is at least partially open, at the top. The clamping element additionally preferably comprises a slit-like recess or at least one projection, respectively a step, the slit-like recess, respectively the projection or the step of the clamping element in the inserting position being substantially open from above and/or the hand side. The slit-like recess, respectively the projection or the step is in other words open, such that a hand-retaining device fastened to the hand may be guided in a natural gripping process onto the pole grip and the coupling element provided on the hand-retaining device may be inserted from the hand side, respectively from above or obliquely from above on the hand side. If it is not a slit but a projection or a step, however, preferably on the whole a slit is still formed, to a certain extent, the one wall of the slit being formed by a wall region of the clamping element and the other side wall by a region of the grip.

The self-latching takes place in this case, in particular, preferably such that the clamping element is moved into the locked position by pulling downward on a coupling element inserted into the slit-like recess and respectively guided on the projection or the step, by rotating or displacing the clamping element, the slit-like recess, respectively the projection or the step preferably being moved behind a stationary blocking region provided on the grip body of the pole grip and being closed thereby.

According to a preferred embodiment of the invention, the clamping element is a preferably block-shaped, pin-shaped, bar-shaped or bolt-shaped element which on its side facing the hand side has the slit-like recess, respectively a projection or a step and which is displaceably mounted in the recess in the top region of the pole grip, the side facing the hand side in the inserting position being substantially arranged above the stationary blocking region arranged on the hand side, and being arranged in the locked position pushed downward behind the stationary blocking region arranged on the hand side by closing the slit-like recess, respectively the projection or the step.

Alternatively, it is possible and preferable to design the clamping element to be tiltable. In other words, according to a further preferred embodiment of the invention the clamping element has preferably a block-shaped, pin-shaped, bar-shaped or bolt-shaped element, which on its first end facing the hand side has the slit-like recess or a projection or a step and which substantially on its second end facing the front face is tiltably mounted about an axis, which preferably is arranged substantially parallel to the direction of extension of the slit-like recess, in the recess in the top region of the pole grip, the first end being arranged in the inserting position substantially above the stationary blocking region arranged on the hand side, and in the locked position being arranged behind the stationary blocking region arranged on the hand side by closing the slit-like recess.

In order to ensure defined positions of equilibrium, it proves advantageous if the device comprises latching elements which hold the clamping element at least in the locked position such that only after exceeding a releasing force may the clamping element be moved from the locked position into the inserting position. At the same time or alternatively, it is possible that the device comprises latching elements which hold the clamping element at least in the inserting position, such that only after exceeding a latching force is the clamping element guided from the inserting position into the locked position, it being possible that the latching elements simultaneously undertake both functions.

Preferably, it is possible to configure the latching elements as ribs, ridges and/or projections arranged in and/or on the clamping element, respectively in and/or on an inner face of the recess adjacent thereto, which possibly are acted upon by an elastic return force, and corresponding grooves, channels and/or recesses. Thus it is possible, for example, to provide a rib on the clamping element and one or two corresponding grooves on the inner face of the recess in which the clamping element is arranged. These two grooves arranged at different positions thus define the two positions, namely the inserting position and the locked position. A transposition (rib on the inner face and groove on the clamping element) is also possible. Instead of a rib it is possible, for example, to provide a displaceably mounted nipple acted upon by a spring, but it is also possible instead of the rib to provide a projection made of a leaf spring or the like. Equivalent solutions are provided to the person skilled in the art substantially without inventive step and are also encompassed by the invention.

According to a further preferred embodiment, means are additionally arranged by means of which the clamping element may also be moved from the locked position into the inserting position without the coupling element inserted. This may, in particular, prove useful or even necessary if the clamping element, without the coupling element fixed therein, has been moved inadvertently into the locked position. These means may, for example, be implemented by the clamping element projecting in a region from the pole grip and this region (for example in the form of a button) allows a displacement, respectively a tilting, of the clamping element into the inserting position.

Moreover, the possibility may be provided to fix, respectively to lock, the clamping element completely in the locked position and/or in the inserting position, i.e. that the clamping element is fixed, for example, via a slide or the like in the locked position and only after releasing the slide may be moved into the inserting position.

A further preferred embodiment of the invention is characterized in that by rotating or displacing the clamping element from the inserting position into the locked position, the recess is moved behind a stationary blocking region provided on the grip body of the pole grip and is closed thereby, and in that the stationary blocking region is a substantially vertical hook-like projection which is formed on the grip body or fastened thereto, preferably a retaining peg or retaining pin arranged substantially parallel to the pole axis. In other words, to a certain extent the clamping element is arranged behind the hook-like device. Typically, the recess has a width ranging from 3-15 mm, preferably ranging from 4-8 mm and/or a depth ranging from 2-20 mm, preferably ranging from 3-15 mm.

According to a further preferred embodiment, it is possible that a safety release device is implemented via a bypass in the stationary blocking region and/or via the design of the connection between the coupling element and the hand-retaining device.

Preferably the coupling element is a movable strap arranged between the thumb and forefinger of the hand-retaining device and, in other words, the slit-like recess is preferably a narrow slit, which is aligned horizontally and substantially perpendicular to the direction of the lower arm in normal use. The coupling element preferably consists, in particular, of a cable or clip or a flexible plastics cored with inherent rigidity. The use of preferably at least partially inherently rigid plastics fibers, possibly provided with a coating and which, in particular, have limited extensibility (for example made of Dyneema®) is possible also.

Preferably the clamping element (and/or the pole grip) at least partially consists of injection-molded plastics.

Further preferred embodiments of the invention are disclosed in the accompanying claims.

BRIEF DESCRIPTION OF THE FIGURES

The invention is to be described in more detail hereinafter with reference to embodiments in combination with the drawings, in which.

Figure 1:
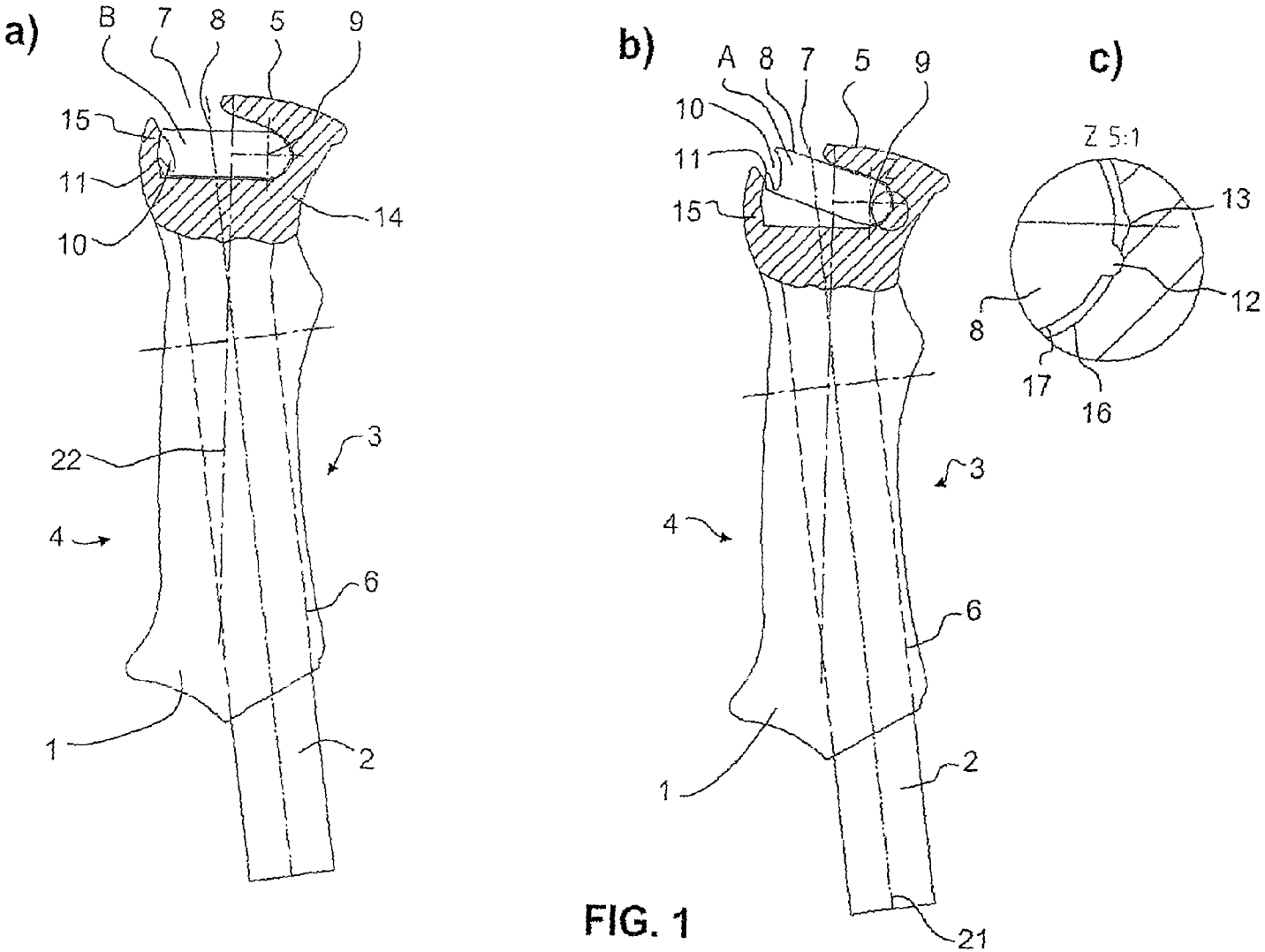
FIG. 1 *a*) shows a section through a, pole grip, the clamping element being shown in the locked position.

*b*) shows a section through a pole grip according to FIG. 1, the clamping element being shown in the inserting position, and

Figure 2:
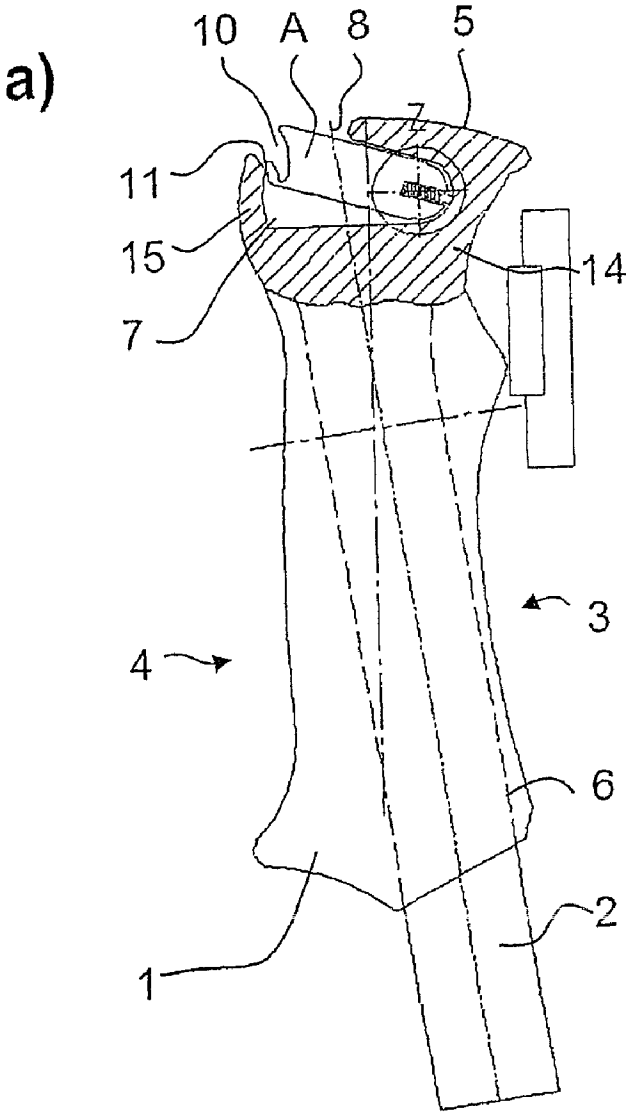
Figure 2:
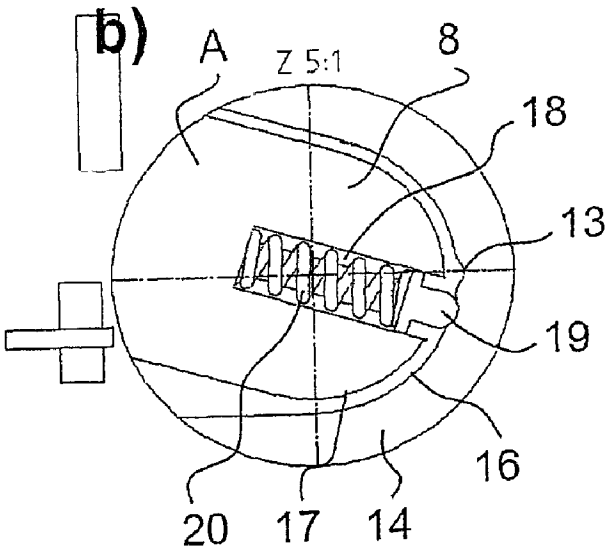

*c*) shows the detailed view Z shown in FIG. 1*b*) enlarged by five times;

FIG. 2 *a*) shows a pole grip according to a further embodiment, a latching means being shown which is acted upon by a spring, and

Figure 3:
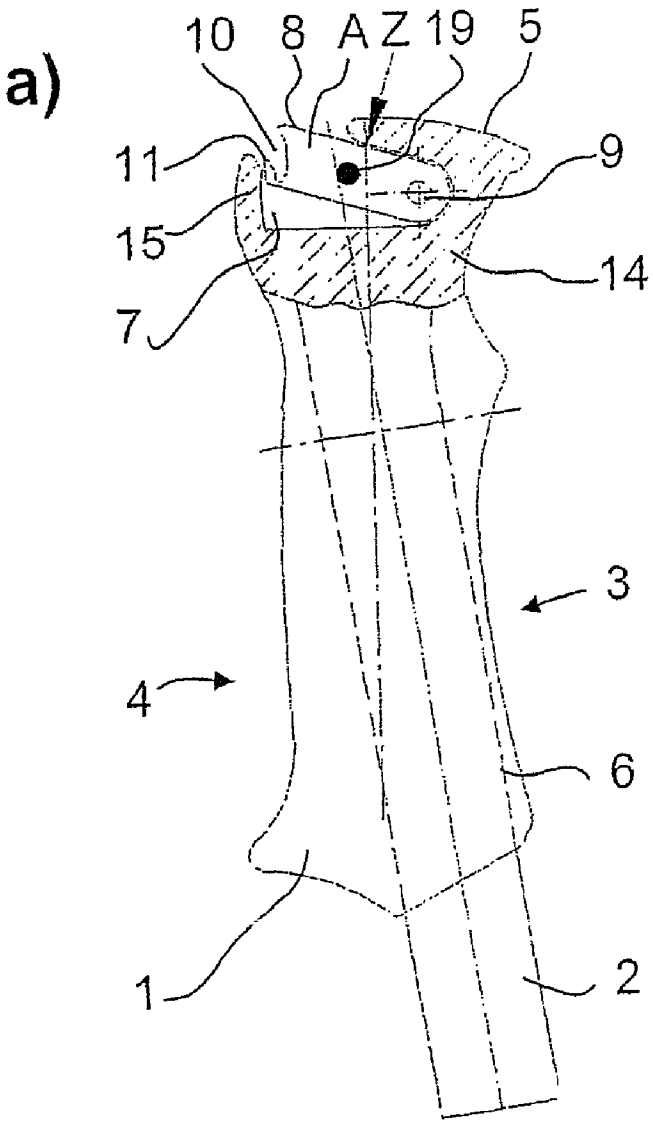
Figure 3:
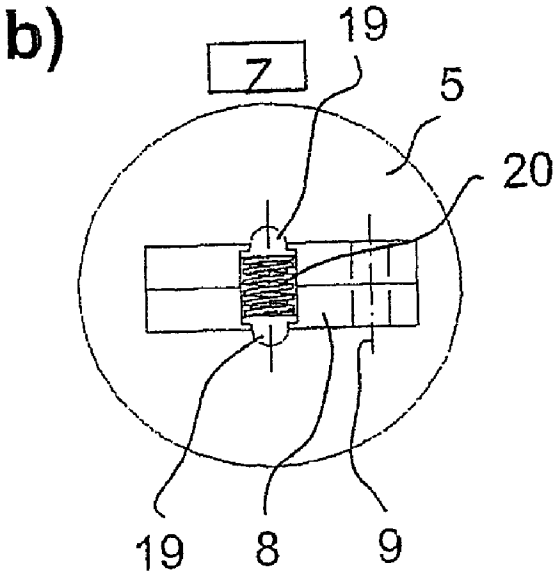

*b*) shows the detailed view Z shown in FIG. 2*a*);

FIG. 3 *a*) shows a section through a further embodiment in the inserting position and

Figure 4:
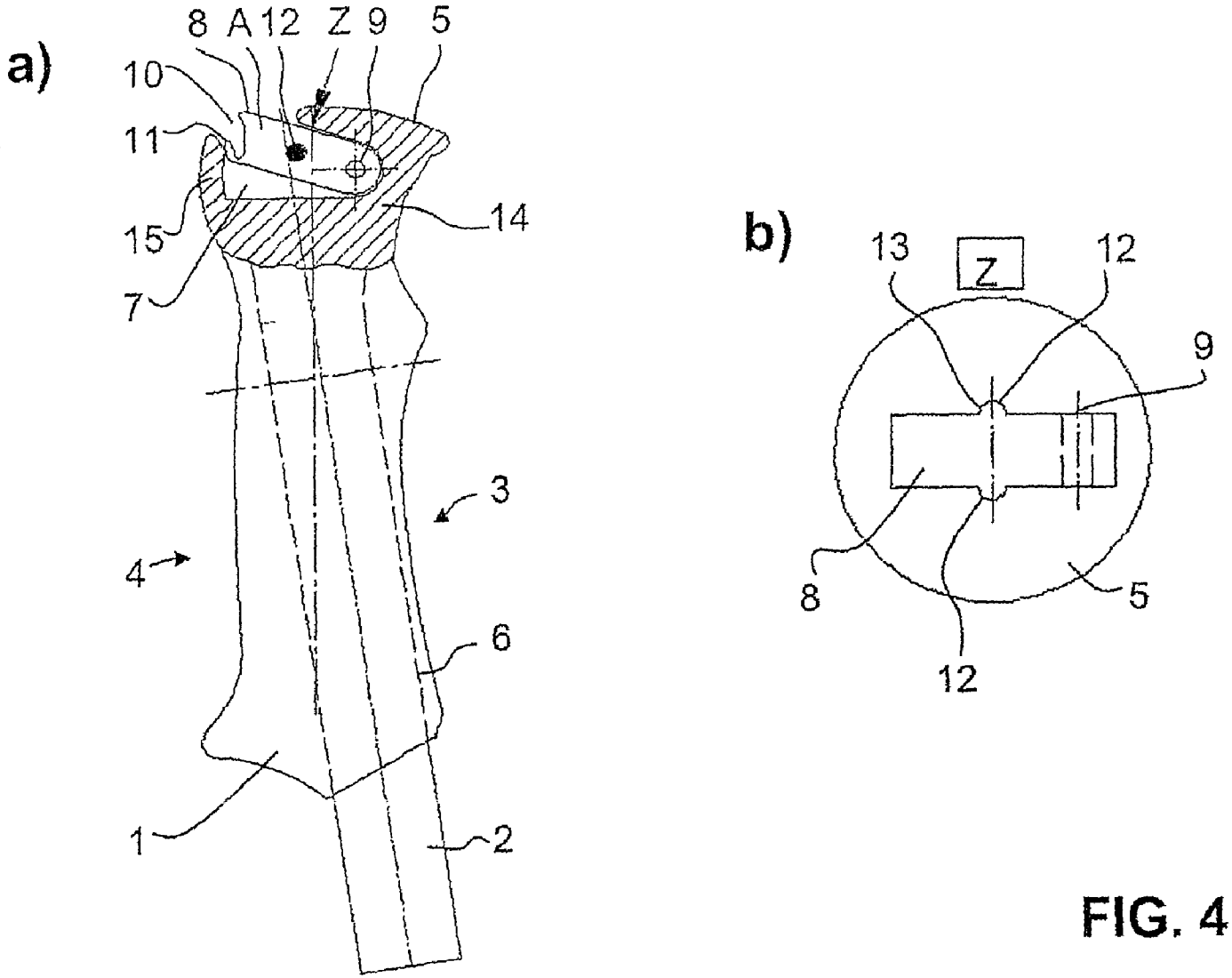

*b*) shows a plan view along the arrow in FIG. 3*a*);

FIG. 4 *a*) shows a section through a further embodiment and

Figure 5:
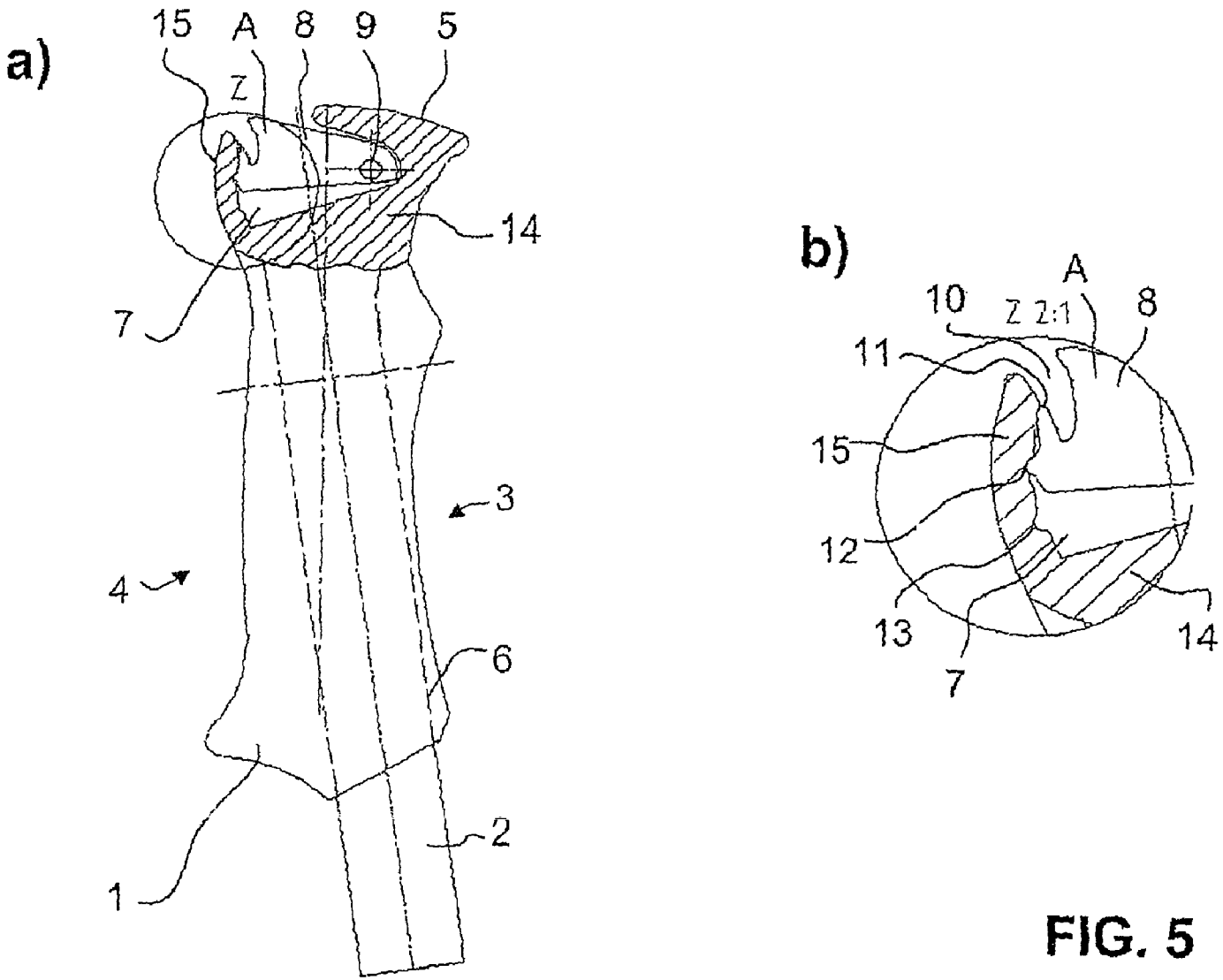
Figure 6:
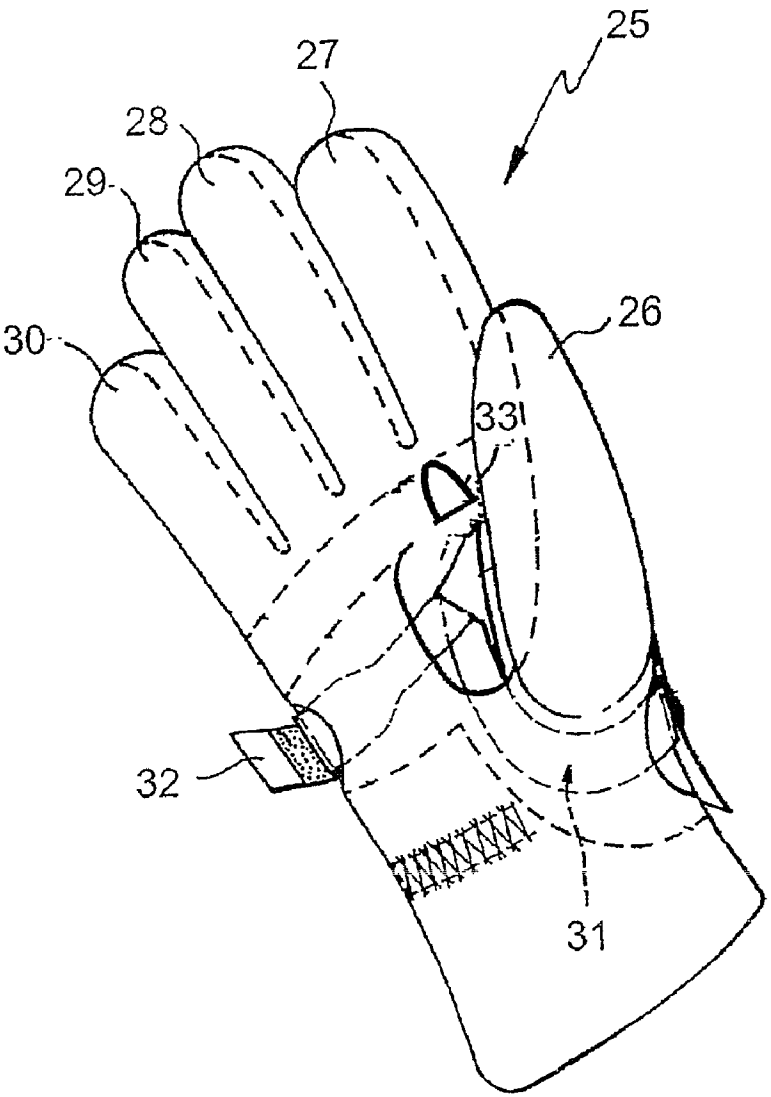

*b*) shows a plan view along the arrow in FIG. 4*a*);

FIG. 5 *a*) shows a section through a further embodiment and b) shows a detail according to the circle Z in FIG. 5*a*); and FIG. 6 shows a hand-retaining device comprising a strap between the thumb and forefinger.

WAYS OF IMPLEMENTING THE INVENTION

In the figures, a pole grip 1 is shown as well as a pole tube 2 which is inserted into a recess 6 of the pole grip 1 and fastened to the pole grip 1. The pole grip is, for example, made from plastics and has an ergonomic design of the outer surface. In this case, the axis 21 of the pole tube is slightly inclined from the axis 22 of the pole grip but a different configuration is also possible.

In its top region 5 the pole grip has a recess 7 which is open at the top, at least open at the top toward the hand side 4. A clamping element 8 is pivotably inserted in this recess 7. The clamping element in this case has at least two different positions. The first position, the so-called inserting position A, is shown in FIG. 1*a*) and the second position, the so-called locked position B, is shown in FIG. 1*b*). The clamping element 8 is block-shaped or bar-shaped and has at its end facing the hand side a transversely extending slit 10 which is accessible from the hand side, respectively obliquely from above and defined by the nose 11.

As is visible from FIG. 1*a*), the recess 7 is designed such that in the locked position a blocking region 15 is arranged in front of this slit. This blocking region 15 is stationary and formed on the grip body 14 of the pole grip 1. The blocking region is, in particular, a hook-like projection 15. The recess 7 is additionally configured in the shape of a pocket facing the front face 3 and accordingly, the rotational movement of the clamping element 8 is restricted. In its frontmost region this pocket is formed with a rounded region 16, said rounded region 16 being adapted to the rounded portion 17 of the clamping element 8.

The clamping element 8, as a result of the design of the recess 7 and proceeding from a situation as shown in FIG. 1*a*), is tiltable in the clockwise direction by approximately at least 5 degrees to usually at most 45 degrees, in particular preferably between 10 and 30 degrees. Said position in which the clamping element is arranged in its maximum tilted position in the clockwise direction, the inserting position A, is shown in FIG. 1*b*). The clamping element 8 is in this case rotated upwards such that now the slit 10 which is completely covered in the locked position by the hook-like projection 15, is completely open.

A strap-like coupling device 33 which may be arranged on a hand-retaining device (see for example FIG. 6 further below), may therefore be inserted into this insertion opening, respectively the slit 10, in a situation as shown in FIG. 1*b*), and by subsequently pulling downward on the hand-retaining device, respectively on the coupling element 33, the clamping element 8 is again returned in the counterclockwise direction into its locked position, as shown in FIG. 1*a*). The coupling element, in the form of a strap 33 or a corresponding clip, guided through the slit 10 is subsequently trapped in FIG. 1*a*) in the slit 10 and behind the blocking region 15.

In order to define clearly at least the locked state B, on the rounded outer contour 17 of the clamping element 8 a rib 12 may be provided, as is shown in FIG. 1*c*). On the rounded region 16 of the internal structure of the recess 7, a corresponding groove 13 is formed for the rotated position in the locked position B. Thus the clamping element 8 reaches the locked position B as shown in FIG. 1*a*), the rib 12 consequently engages in the groove 13 and is latched there. Only the application of a specific minimum upward releasing force on the strap 33, with such a design, accordingly moves the clamping element 8 from the locked position B into the inserting position A.

As shown in FIG. 2, these latching means may also be specifically designed. Thus in this case, for example, a locking element in the form of a small pin 19 with a nose with a helical spring 20 is arranged in a recess or bore 18 in the clamping element 8. By means of the spring 20, the locking element 19 is pressed against the rounded flank 16, and when reaching the rotated position of the locked position B, the tip of the locking element 19 moves into the recess 13, as is shown in FIG. 2*b*), and locks the clamping element in the locked position. By adjusting the spring force of the helical spring, in such a construction the releasing force may be adjusted and additionally a construction according to FIG. 2 does not have the drawback that, with intensive use, the nose is gradually worn out, as shown in FIG. 1*c*) by the reference numeral 12, and thus the locking effect slowly fades.

A further alternative possibility of the arrangement of locking means is shown in FIG. 3. In this case a locking means is produced in the form of two locking elements emerging from the sides of the clamping element 8, which are acted upon on both sides but by a single helical spring 9. The locking elements 19 engage in corresponding grooves or recesses in the side wall of the recess 7.

In this case, the clamping element 8, moreover, is not simply inserted in the recess but additionally an axis 9 is specifically provided about which the clamping element is rotatably mounted in the recess 7. The presence of such an axis is, however, not obligatory.

A further embodiment of a lock is shown in FIG. 4. In this case, similar to the embodiment according to FIG. 1 there are projections 12 which are formed on the clamping element but to the side, and which engage in corresponding recesses in the lateral inner face of the recess 7.

FIG. 5 shows a further arrangement of the locking means. In this case, as is revealed in particular from the detailed view according to FIG. 5*b*), a rib-like projection 12 is formed on the clamping element on the hand side below the nose 11. Said projection engages in the locked position B in a corresponding groove, which is provided on the inner face of the hook-like projection 15. In this case, however, not only the locked position B but also the inserting position A is defined by a corresponding groove, whereby two clearly latched positions of the clamping element 8 result.

As it may possibly occur that the clamping element may reach the locked position B, without the strap of the hand-retaining device being arranged in the slit 10 (for example as a result of an impact) it proves advantageous to provide the possibility of moving the clamping element 8 from the locked position E into the inserting position A, even without the strap inserted into the slit 10. This is possible in the embodiment according to FIG. 5, for example, by a button being attached to the clamping element 8 on the upper face, on which it is possible to move the clamping element 8 in the clockwise direction by means of the thumb. It is also possible, for example, to design the clamping element 8 to be slightly longer at the front and to allow said clamping element to project partially from a slit at the front out of the top region 5 of the pole grip. The clamping element 8 may then also be rotated there by appropriate manipulation.

FIG. 6 shows a hand-retaining device which is suitable for interaction with such a pole grip construction. The hand-retaining device is designed as a glove 25 and said glove 25 in principle has a fastening guide as is disclosed in DE 19751978 C2. Regarding the details of this fastening guide, which amongst others comprises a peripheral fastening device 31 as well as adjusting means 32, which for example may be configured as a Velcro fastening, reference is made to DE 19751978 C2.

Instead of the hook-like connecting element shown in DE 19751978, however, a strap 33 is arranged in the V region between the thumb 26 and forefinger 27. The strap is made from a cable, for example stainless steel, aramid, Dyneema, or the like, with a thickness of 1.5 mm. The cable is, for example, a twisted cable, which possibly may be provided with a coating of plastics or metal, or about which a small tube of brass may be placed, or which has a covering made of, for example, thermoplastically formed synthetic material.

The strap 33 should be fastened to the hand-retaining device such that the forces occurring during use of the pole are well distributed over the hand. This is ensured with a hand-retaining device according to FIG. 6.

LIST OF REFERENCE NUMERALS

1 Pole grip
2 Pole tube
3 Front side
4 Hand side
5 Top region of 1
6 Recess for 2 in 1
7 Recess in 5
8 Clamping element
9 Rotational axis of 8
10 Slit
11 Nose in 8
12 Rib, ridge, projection
13 Groove, channel, recess
14 Grip body
15 Blocking region on the pole grip, hook-like projection
16 Rounded region of 7
17 Rounded region of 8
18 Recess in 8 for 19
19 Locking element
20 Helical spring
21 Axis of pole tube
22 Axis of pole grip
25 Glove
26 Thumb
27 Forefinger
28 Middle finger
29 Ring finger
30 Little finger
31 Fastening strap
32 Fastening tab
33 Coupling element, strap
A Inserting position
B Locked position

The invention claimed is:

1. A pole grip, comprising a grip body and with a device for self-latching fastening of a hand-retaining device in the form of a wrist strap or glove, the device for self-latching fastening of a hand-retaining device comprising at least one first recess for receiving a coupling element provided on the hand-retaining device, a clamping element, wherein the clamping element is arranged rotatably or displaceably in a second recess in a top region of the pole grip, wherein the clamping element comprises said first recess, said first recess being a slit-like first recess, or a recess defined by a projection or a step, the slit-like first recess, or the recess defined by the projection or the step of the clamping element in an inserting position of the clamping element being open substantially from above and/or the hand side, such that the coupling element of a hand-retaining device not connected to the pole grip may be inserted into said first recess, and the device being able to be moved into a locked position by tilting or displacing the clamping element, in which the first recess is closed and the coupling element is trapped in the first recess, and wherein the clamping element is moved into the locked position by pulling downward on the coupling element inserted into the slit-like first recess, or guided on the projection or the step, by rotating or displacing the clamping element, the slit-like first recess, or the recess defined by the projection or the step being moved behind a stationary blocking region provided on the grip body of the pole grip and being closed thereby.

2. The pole grip as claimed in claim 1, in particular for walking poles, trekking poles, alpine ski poles, cross-country ski poles and Nordic walking poles, wherein the clamping element is a block-shaped, pin-shaped, bar-shaped or bolt-shaped element which on its side facing the hand side has the slit-like first recess, or the recess defined by the projection or the step, and which is displaceably mounted in the second recess in the top region of the pole grip, the side facing the hand side in the inserting position being substantially arranged above the stationary blocking region arranged on the hand side, and being arranged in the locked position pushed downward behind the stationary blocking region arranged on the hand side by closing the slit-like first recess, or the recess defined by the projection or the step.

3. The pole grip as claimed in claim 2, wherein the clamping element is a block-shaped, pin-shaped, bar-shaped or bolt-shaped element, which on its first end facing the hand side has the slit-like first recess, or the recess defined by the projection or the step, and which substantially on its second end facing the front side is tiltably mounted about an axis, which is arranged substantially parallel to the direction of extension of the slit-like first recess, in the second recess in the top region of the pole grip, the first end being arranged in the inserting position substantially above the stationary blocking region arranged on the hand side, and in the locked position being arranged behind the stationary blocking region arranged on the hand side by closing the slit-like first recess, or the recess defined by the projection or the step.

4. The pole grip as claimed in claim 1, wherein the device comprises latching elements which hold the clamping element at least in the locked position such that only after exceeding a releasing force may the clamping element be moved from the locked position into the inserting position.

5. The pole grip as claimed in claim 1, wherein the device comprises latching elements which hold the clamping element at least in the inserting position such that only after exceeding a latching force is the clamping element guided from the inserting position into the locked position.

6. The pole grip as claimed in claim 4, wherein the latching elements are ribs, ridges, and/or projections arranged in and/or on the clamping element, respectively in and/or on an inner face of the second recess adjacent thereto, which possibly are acted upon by an elastic return force, and corresponding grooves, channels and/or depressions.

7. The pole grip as claimed in claim 1, wherein means are arranged by which the clamping element may also be moved from the locked position into the inserting position without the coupling element inserted.

8. The pole grip as claimed in claim 1, wherein by rotating or displacing the clamping element from the inserting position into the locked position, the first recess is moved behind a stationary blocking region provided on the grip body of the pole grip and is closed thereby, and in that the stationary blocking region is a substantially vertical hook-like projection which is formed on the grip body or fastened thereto.

9. The pole grip as claimed in claim 1, wherein the first recess has a width ranging from 3-15 mm, and/or a depth ranging from 2-20 mm.

10. The pole grip as claimed in claim 1, wherein the coupling element is a movable strap arranged between the thumb and forefinger of the hand-retaining device.

11. The pole grip as claimed in claim 1, wherein the clamping element and/or the pole grip at least partially consists of injection-molded plastics and/or cork, possibly with a coating.

12. The pole grip as claimed in claim 1, wherein the coupling element is a movable strap arranged between the thumb and forefinger of the hand-retaining device which consists of a cable or clip or a flexible plastics cord with inherent rigidity.

13. The pole grip as claimed in claim 5, wherein the latching elements are ribs, ridges, and/or projections arranged in and/or on the clamping element, respectively in and/or on an inner face of the second recess adjacent thereto, which possibly are acted upon by an elastic return force, and corresponding grooves, channels and/or depressions.

* * * * *